United States Patent [19]

Aronowitsch et al.

[11] Patent Number: 5,048,799

[45] Date of Patent: Sep. 17, 1991

[54] MANUAL DRIVE MECHANISM FOR A WINCH OR SIMILAR APPLIANCE

[76] Inventors: Mikael E. G. Aronowitsch, Predikantväge 4, S-183 65 Täby; Stefan E. M. Aronowitsch, Centralvägen 4, S-150 16 Hölö ; Karl Lyth, Polhemsagtan 31, S-112 30 Stockholm, all of Sweden

[21] Appl. No.: 418,958

[22] Filed: Oct. 10, 1989

Related U.S. Application Data

[63] Continuation of Ser. No. 286,089, filed as PCT SE87/00564 on Nov. 27, 1987, published as WO88/04275 on Jun. 16, 1988, abandoned.

[30] Foreign Application Priority Data

Dec. 3, 1986 [SE] Sweden ..... 8605201

[51] Int. Cl.[5] ..... B66D 1/04; B66D 1/14

[52] U.S. Cl. ..... 254/344; 242/323; 254/371; 74/421 R; 74/606 R; 74/545

[58] Field of Search ..... 254/371, 376, 344, 342; 74/545, 606 R, 421 R, 801; 242/255, 283, 323

[56] References Cited

U.S. PATENT DOCUMENTS

| | | | |
|---|---|---|---|
| Re. 24,153 | 5/1956 | Lockwood | 74/545 |
| 725,128 | 4/1903 | Peck | 254/344 |
| 2,242,972 | 5/1941 | Frain | 242/84.1 J |
| 2,335,752 | 11/1943 | Geiger | 242/255 |
| 2,374,450 | 4/1945 | Nelles | 254/342 X |
| 2,487,387 | 11/1949 | Sears | 242/255 X |
| 2,615,352 | 10/1952 | Mies | 242/255 X |
| 2,836,995 | 6/1958 | Heddy | 242/323 |
| 3,281,120 | 10/1966 | Richardson | 254/376 |
| 3,776,517 | 12/1973 | Davis et al. | 254/376 |
| 4,627,374 | 12/1986 | Wright | 254/371 |

FOREIGN PATENT DOCUMENTS

| | | | |
|---|---|---|---|
| 70870 | 7/1987 | Finland . | |
| 31245 | 5/1970 | German Democratic Rep. | 254/342 |
| 57785 | 3/1937 | Norway . | |
| 1142426 | 2/1985 | U.S.S.R. | 254/371 |
| 1422426 | 2/1985 | U.S.S.R. | 254/371 |
| 540056 | 10/1941 | United Kingdom | 254/342 |
| 88/04275 | 6/1988 | World Int. Prop. O. | 254/371 |
| 88104275 | 6/1988 | World Int. Prop. O. | 254/371 |

*Primary Examiner*—Katherine Matecki

*Attorney, Agent, or Firm*—Nies, Kurz, Bergert & Tamburro

[57] ABSTRACT

An arrangement for manually driving a winch (1) or like rotatable device, comprising an input rotational shaft (2) which is actuable for driving the rotational device and arranged to rotate an external drum (3) or the like at a given transmission ratio, the arrangement comprising a preferably peg-like drive part (4) which co-acts rotationally with the input shaft without mutual rotation therebetween and further comprises a crank arm (5) or the like intended for co-action with the drive part such as to produce a rotational movement.

The arrangement is particularly characterized by devices (12) which transmit rotational movement of the crank arm (5) to the drive part (4) at a given transmission ratio.

9 Claims, 2 Drawing Sheets

MANUAL DRIVE MECHANISM FOR A WINCH OR SIMILAR APPLIANCE

This application is a continuation of application Ser. No. 07/286,089, filed as PCT SE87/00564 on Nov. 27, 1987, published as WO88/04275 on Jun. 16, 1988, and now abandoned.

BACKGROUND OF THE INVENTION

The present invention relates to an arrangement for driving manually a winch or like device, of the kind incorporating an input rotational shaft which is intended to be activated to drive the winch and to rotate an external drum or the like at a given transmission ratio, said arrangement being movable.

In so-called sheet winches of the aforedescribed kind the input shaft is intended to be rotated by means of a crank-like handle which is mounted onto the shaft through the medium of a peg-like part.

It is desirable in many cases to have access to at least two different transmission ratios, inter alia so that the winch can be adapted to the strength of the person using the winch. Winches of this kind are, or course, also found for use with recreational sailing vessels. These winches, however, are much more expensive than the simple winches normally used, which are in themselves relatively expensive. This renders the choice of exchanging a simple winch for winches which incorporate more than one transmission ratio economically unattractive.

SUMMARY OF THE INVENTION

The present invention provides a winch arrangement which solves the aforedescribed problems. Thus, the inventive arrangement enhances the use possibilities of both simple winches and winches which incorporate more than one transmission ratio.

Thus, the invention relates to an arrangement for manually driving a winch, or like rotatable device, which includes an input rotational shaft which is intended to be activated for driving the rotational device and arranged to rotate an external drum or corresponding device at a given transmission ratio, the inventive arrangement having a peg-like drive part which co-acts with the input shaft such as to rotate said shaft without mutual rotation therebetween, and further having a crank arm or like device which is intended for co-action with said drive part for producing rotational movement.

The arrangement is particularly characterized by devices which are effective to transmit rotary movement of the crank arm to the drive part at a given transmission ratio.

BRIEF DESCRIPTION OF THE DRAWING

The invention will now be described in more detail with reference to exemplifying embodiments thereof and with references to the accompanying drawings, in which

FIG. 4*a* is a schematic side view of an arrangement corresponding essentially to the arrangement illustrated in FIGS. 1–3, although in this case the support member for co-action with a sheet or like rope have a different configuration, while

GENERAL DESCRIPTION

Figure 1:
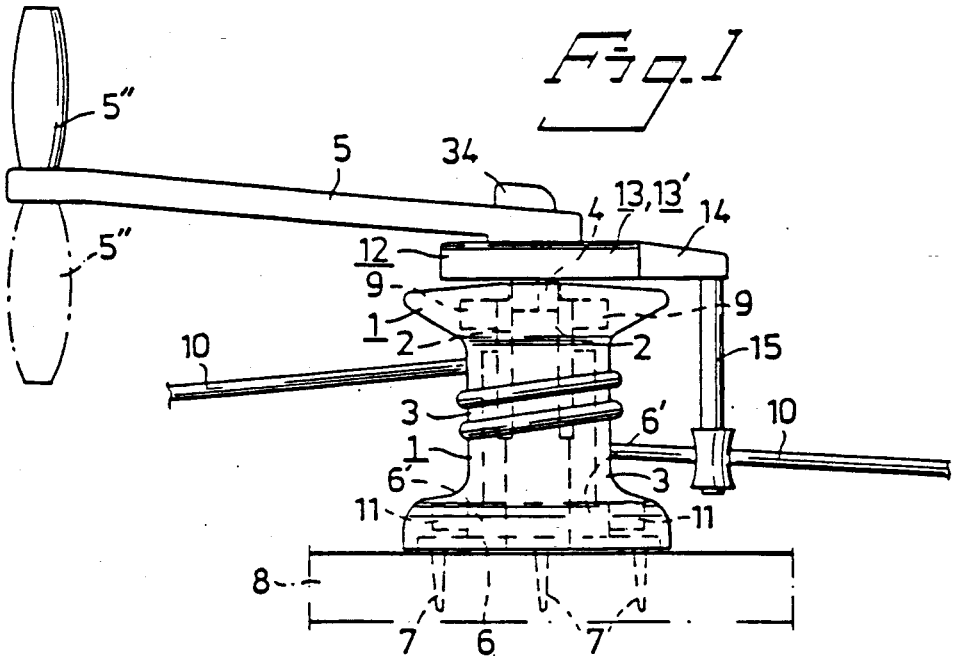
FIG. 1 illustrates schematically and in side view a first embodiment of an arrangement according to the invention incorporated in a sheet winch.

The embodiment illustrated in FIG. 1 comprises a rotatable device 1 in the form of a so-called sheet winch, comprising a rotatable shaft 2 in the form of a sleeve-like part which is actuable to rotate the device 1 and which is intended to rotate an externally located drum 3 at a given transmission ratio, and wherein auxiliary devices are provided for driving the device 1 manually, these devices normally including a peg-like drive part 4 which is intended to co-act drivingly with the shaft 2, such as to rotate said shaft without mutual rotation therebetween, and also a crank arm 5 or like device which is intended to co-act with the drive part 4 in a manner to effect rotational movement of part 4 and shaft 2. The winch of the illustrated embodiment is of a known kind and is constructed solely for one operating speed and has a transmission ratio of 1:1, i.e. the drum 3 rotates at the same speed as the shaft 2, i.e. the sleeve-like part 2. The sleeve-part 2 is fluted on its outer peripheral surface and is connected to a base-part 6 for rotation relative thereto, the base-part 6 being secured, e.g., to a gunwhale 8 by means of screws 7. The sleeve-part 2 is arranged to co-act with latching devices 9 located on the drum 3, such that the drum 3 is driven by the sleeve-like part 2 in one given direction with the latching devices engaged in a drum latching position, and is freely rotatable in the opposite direction, with the latching devices out of latching engagement with the drum. The reference 10 identifies a sheet or like rope which is to be hauled or pulled by means of the winch, whereas the reference 11 identifies latching devices which are located on the drum 3 and which co-act with an externally fluted part 6' on the base-part 6, such as to prevent rotation of the drum in response to the tension engendered in the sheet or rope, i.e. drum rotation in a direction opposite to the direction of rotation effected by the drive part 4.

The illustrated inventive arrangement includes a drive transfer device 12 for transmitting rotary movement of the crank arm 5 to the drive part 4, i.e. the peg-like part 4, at a given transmission ratio.

The intention herewith is to complement the transmission ratio of the winch 1 or corresponding device, and hence the transmission ratio provided by the device 12 will preferably differ from the winch transmission ratio 1:1. The crank arm 5 and the drive part 4 and a gear arrangement co-acting therewith for producing said transmission ratio is suitably supported by a carrier assembly 13, including a housing 13'. In this case, the carrier assembly 13 has holding-up (retaining) parts which are essentially non-rotatable and which are stationary such as to provide counterforce structure during the transmission of rotational movement to the drive part 4. The housing 13' or the like suitably includes the holding-up parts.

Figure 4A:
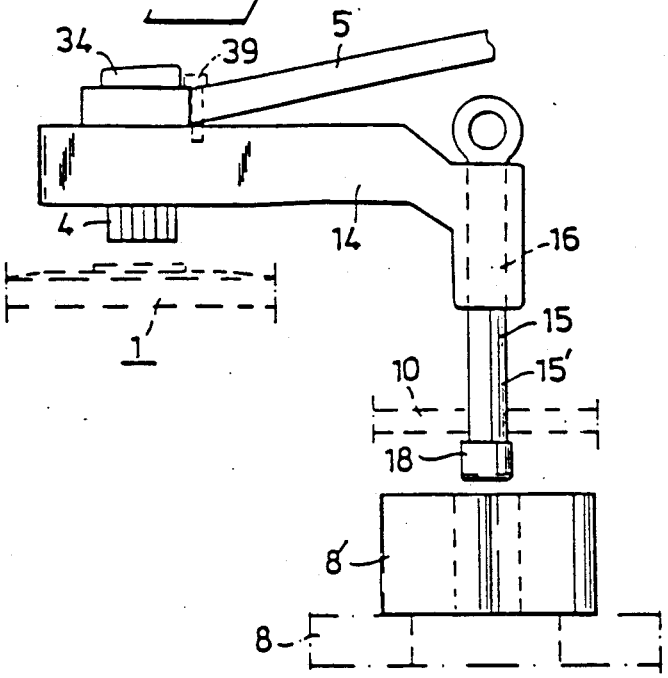
Figure 4B:
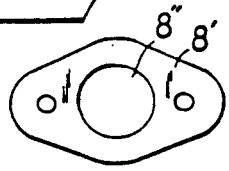
FIG. 4*b* is an axial view of an auxiliary fitting which cooperates with the support member of FIG. 4*a;*
Figure 6:
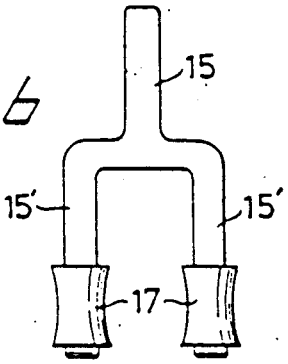
FIG. 6 illustrates schematically a bifurcate member forming a support member for the arrangement according to the invention.

In the case of the embodiment illustrated in FIG. 1, the holding-up parts are intended to co-act with a sheet 10 which is arranged on and extends from the drum 3, therewith to be held firm against rotation. In this regard there is preferably provided a carrier arm 14 which extends essentially radially in relation to the rotational axis of the drive part 4 and which carries a support member 15 in supportive engagement with the sheet 10. The support member, e.g. of FIGS. 4 and 6, may for instance have the form of a bifurcate member 15 having two legs 15' which are intended to straddle the sheet 10. As illustrated in FIG. 4, the support member 15 may also include an axially extending part 16 which is preferably rotatable and which extends essentially parallel with the longitudinal axis of the drive part 4, said axially extending part 16 also being arranged for limited axial movement. Each of the legs 15' may be provided with a respective rotatable contact roller 17, which presents a concave outer surface for guiding the sheet 10 as shown in FIG. 6. Alternatively, the legs 15' of the bifurcate member may be given a highly polished surface finish and may conveniently be provided with a respective end stop 18, as shown in FIG. 4*a*.

Figure 7:
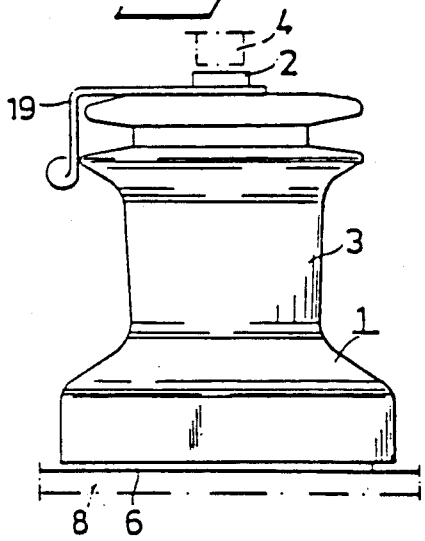
FIG. 7 illustrates schematically a sheet winch provided with a sheet arm for so-called self-tailing functions.

In accordance with other embodiments, the holding-up (retaining) parts may be arranged for connection to the gunwhale or like surface 8 to which the winch is secured, either directly or indirectly. The arrangement will preferably include for this purpose a connecting device which extends through a central, axial part of the winch. One example of this type of winch construction is found in the self-tailing winch illustrated in FIG. 7, in which an arm 19 is stationarily mounted in relation to the drum 3 and is connected to the base part 6 of the winch. In this case, holding-up parts can be combined with and/or caused to co-act with the arm 19. It will be appreciated that the holding-up parts may be stationarily mounted in the same manner, or essentially the same manner as the arm 19, without the provision of an arm therefor. Another example is indicated in FIG. 4. In this case a fitting 8' is fixedly mounted on the gunwhale or like support surface 8 and incorporates a hole or bore 8'' into which a shank part 15' of the member 15 is inserted and herewith locked against displacement transversely to the direction of the longitudinal axis of the shank part in response to said rotational movement. It will be understood that in many cases a support member 15 which comprises solely one shank part 15' will suffice, i.e. a support member 15 having the configuration illustrated in FIG. 4*a*.

Figure 2:
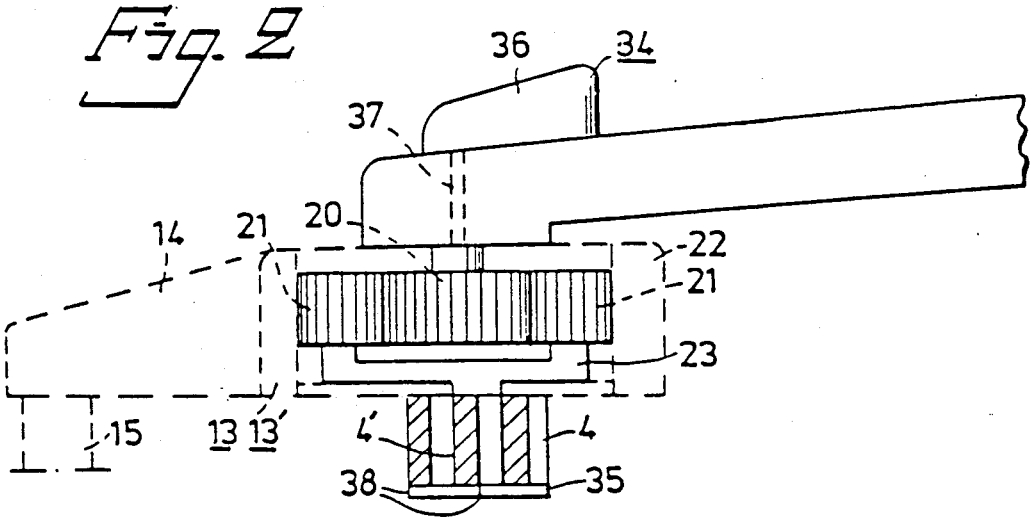
FIG. 2 is a schematic side view, in greater detail, of an embodiment of an arrangement according to FIG. 1, where certain internal components are shown in full lines and certain outer components are shown in broken lines.
Figure 3:
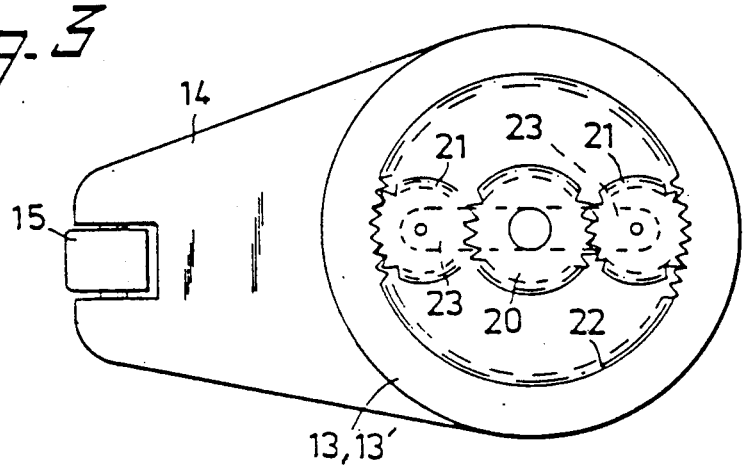
FIG. 3 illustrates the arrangement shown in FIG. 2 from above in said Figure although in this case all outer components are shown in full lines and parts of the upper side of the arrangement and the crank arm of the inventive arrangement have been omitted.

The transmission devices 12, FIG. 1, by means of which the aforesaid transmission ratio is obtained may have several mutually different forms. In the case of the embodiments illustrated in FIGS. 2 and 3, the transmission ratio is obtained through a planet gear, of which the illustrated arrangement constitutes one example. The illustrated planet gear system includes a centrally located sun gear which is connected for rotation to the arm 5, planet wheels 21 which co-act with the sun gear 20, a circumferentially extending gear ring 22, and planet arms 23 which are connected drivingly to the drive part 4, for rotating said drive part in the illustrated manner. It will be understood, however, that the gear system may have a construction different to that illustrated, e.g. it may comprise three planet wheels 21 and three arms 23. One advantage afforded by a planet gear in the present context is that is has a low vertical height.

Figure 5:
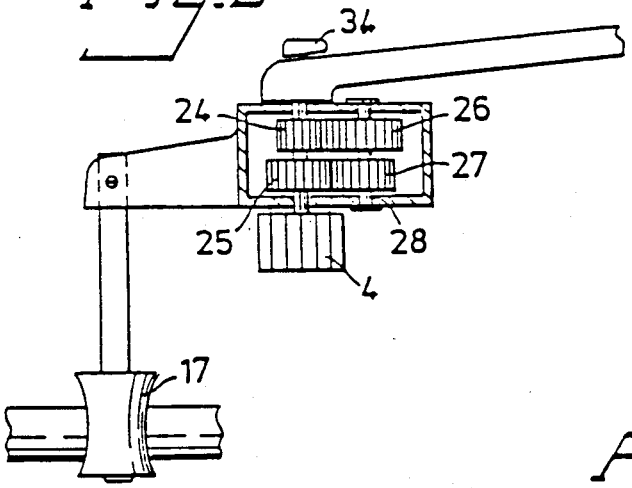
FIG. 5 is a schematic side view of a second embodiment of an arrangement according to the invention, where certain outer components have been omitted in order to illustrate the inner components of the arrangement.

In the case of the FIG. 5 embodiment, the desired transmission ratio is achieved through the medium of a gear transmission which includes two pairs of mutually co-acting gear wheels, of which a respective gear wheel 24, 25 of each gear wheel pair is intended for input rotational movement, produced by the crank arm 5 and for output rotational movement intended for the drive part 4, and the other gear wheels 26, 27 of each gear wheel pair are mutually connected together, e.g. by mounting said gear wheels on a common shaft 28.

It will be understood that embodiments additional to the aforedescribed embodiments are also conceivable in the present context. For example, embodiments can be conceived which are essentially similar to the FIG. 5 embodiment but in which gear wheels are connected by chains or the like instead of co-acting directly. Similarly, embodiments are conceivable in which the gear wheels are driven by V-belts connecting said wheels.

Figure 8:
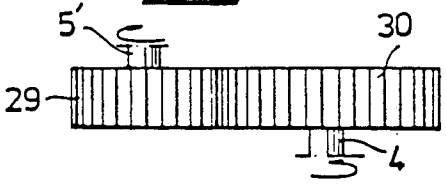
FIG. 8 illustrates schematically a third embodiment of an arrangement for providing a given transmission ratio.

FIG. 8 illustrates an embodiment in which two gear wheels 29, 30 are arranged to co-act with one another, wherewith the input rotational shaft 5' is connected to one gear wheel and the drive part 4 is connected to the other. This will provide a structure of low vertical height. The shaft 5' and the part 4, however, rotate in mutually opposite directions. There is also obtained a given distance between the rotational axes of the shaft 5' and the drive part 4.

Figure 9:
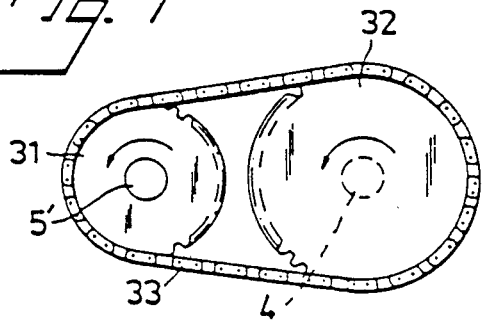
FIG. 9 illustrates schematically a fourth embodiment of an arrangement for providing a given transmission ratio.

FIG. 9 illustrates an embodiment in which two gear wheels 31, 32 are connected together by means of a chain 33. This arrangement provides a structure of low vertical height, where the shaft 5' and the drive pump 4 rotate in mutually the same direction. A given distance is obtained between the rotational axes of the shaft 5' and the drive part 4. A variant which incorporates the use of a V-belt can also be employed in this case.

The manner in which the inventive arrangement functions will be evident to a large extent from the aforegoing. Thus, there is obtained a transmission ratio which is additional to the transmission ratio of the winch itself, irrespective of whether the winch transmission ratio is 1:1 or whether the winch is "multi-geared".

It will also be seen from the aforegoing that the inventive arrangement affords a particularly valuable facility for enhancing flexibility with regard to the transmission ratios of both winches that are under construction and existing winches. The arrangement offers an economically attractive alternative to the choice of a more expensive winch or of changing one winch for another.

The invention has been described in the aforegoing with reference to a number of embodiments thereof. It will be understood, however, that other embodiments are conceivable and that modifications can be made without departing from the scope of the invention.

For example, variants (not shown) are conceivable in which the drive part 4 consists of a sleeve-like part which is arranged to co-act drivingly with a peg-like part on the winch.

Other conceivable variants are those which include a rotational part which is fixedly connected to the crank arm 5 or the like and in which, when using this rotational part, the arrangement has a transmission ratio of 1:1, and which includes on the crank arm 5 a grip 5'' which projects outwardly from said arm and which can be adjusted directionally, as illustrated by the alternative grip positions shown in full lines and chain lines respectively in FIG. 1, thus enabling the arrangement to be reversed in an apparent manner.

The arrangement also conveniently includes locking devices identified generally by reference 34, intended for preventing the arrangement from being withdrawn from the sleeve-like part 2, subsequent to inserting the drive part 4 thereinto. These locking devices may be of any known kind, and may include a square plate 35, indicated in FIG. 2, capable of being rotated by means of a shaft 37, through the medium of a knob 36, such as to bring at least one corner 38 of the plate 35 into locking engagement with an abutment surface (not shown) in the sleeve-like part 2, wherewith the plate is displaced or stepped circumferentially around the drive part 4, relative to corner parts 4' thereof, FIG. 2.

The arrangement may also include a cotter 39 or like locking device schematically shown in FIG. 4*a*, the cotter being intended to prevent rotation of the crank arm 5 and the drive part 4. When the pin is inserted, rotation of the drive part 4 is corresponded directly by rotational movement of the crank arm, i.e. there is obtained a transmission ratio of 1:1.

The invention shall not therefore be considered limited to the described and illustrated embodiments, since modifications can be carried out within the scope of the following claims.

We claim:

1. A manual drive arrangement for use in combination with and for manually driving a winch, said winch including an external drum and a rotational input shaft providing a drive for the winch and arranged to rotate said external drum at a first transmission ratio, the manual drive arrangement being separable from said winch and including a rotatable drive part, means including parts of said drive part and parts of said input shaft for non-rotatably coaxially coupling said drive part and said input shaft and enabling said manual drive arrangement to be coupled to and uncoupled from said drive part by relative axial shifting movement, of the drive arrangement and the drive part, so that the drive arrangement can be readily selectively removed from or placed on the winch, said manual drive arrangement further comprising a crank arm and drive transmission means enabling said crank arm to drivably co-act with said drive part to provide rotational movement to said drive part; wherein said separable manual drive arrangement constitutes a removable unit comprising said drive transmission means (12) connected between said crank arm and said drive part for transmitting rotational movement of the crank arm (5) to said drive part (4) at a second predetermined transmission ratio differing from said first transmission ratio of the winch, said manual drive arrangement further comprising a carrier unit (13) carrying said crank arm (5), said drive part (4) and said transmission means (12); torque reaction retaining means (14, 15) on said carrier unit, essentially non-rotationally mounted relative to the carrier unit; and abutment means at a fixed location relative to the winch enabling said torque reaction retaining means, and the carrier unit to which the retaining means is mounted, to be selectively rendered rotatably stationary by abutting said abutment means during the transmission of rotational movement to the drive part (4) by the crank arm, said winch being a self-tailing which which includes a sheet arm; and said torque reaction retaining means will co-act with said sheet arm (19) of said self-tailing winch.

2. A manual drive arrangement for use in combination with and for manually driving a winch, said winch including an external drum and a rotational input shaft providing a drive for the winch and arranged to rotate said external drum at a first transmission ratio, the manual drive arrangement being separable from said winch and including a rotatable drive part, means including parts of said drive part and parts of said input shaft for non-rotatably coaxially coupling said drive part and said input shaft and enabling said manual drive arrangement to be coupled to and uncoupled from said drive part by relative axial shifting movement, of the drive arrangement and the drive part, so that the drive arrangement can be readily selectively removed from or placed on the winch, said manual drive arrangement further comprising a crank arm and drive transmission means enabling said crank arm to drivably co-act with said drive part to provide rotational movement to said drive part; wherein said separable manual drive arrangement constitutes a removable unit comprising said drive transmission means (12) connected between said crank arm and said drive part for transmitting rotational movement of the crank arm (5) to said drive part (4) at a second predetermined transmission ratio differing from said first transmission ratio of the winch, said manual drive arrangement further comprising a carrier unit (13) carrying said crank arm (5), said drive part (4) and said transmission means (12); torque reaction retaining means (14, 15) on said carrier unit, essentially non-rotationally mounted relative to the carrier unit; and abutment means at a fixed location relative to the winch enabling said torque reaction retaining means, and the carrier unit to which the retaining means is mounted, to be selectively rendered rotatably stationary by abutting said abutment means during the transmission of rotational movement to the drive part (4) by the crank arm, said winch being for use in combination with a sheet, and wherein said sheet encircles and has a portion which runs off from said drum to a workpiece, said retaining means (14, 15) will co-act with said portion of said sheet running off from the drum (3) which constitutes said abutment means, whereby said retaining means is maintained against being rotated by said crank arm.

3. The combination according to claim 2, wherein said manual drive arrangement further comprises an outwardly projecting carrier arm (14) on said carrier unit which extends substantially radially in relation to the rotational axis of said drive part (4) and said retaining means carries a support member (15) which engages the abutment means (10).

4. An arrangement according to claim 3, wherein the support member (15) comprises at least one support leg (15') said support member including an axial part (16) which extends substantially parallel with the longitudinal rotational axis of said drive part (4), said axial part being arranged for limited axial movement relative to said carrier arm and being rotatable.

5. An arrangement according to claim 4, wherein a fitting (8') is provided to be mounted on a fixed support surface adjacent the winch (1), said fitting comprising said abutment means and being adapted to receive said support leg (15') and thereby lock the rotational device against displacement transversely to the axial direction of said support leg when said crank arm is rotated.

6. An arrangement according to claim 2, wherein a planetary gearing (20, 21, 22, 23) is included in said transmission device for providing the second predetermined transmission ratio of the manual drive arrangement.

7. An arrangement according to claim 2, wherein at least two meshed gear wheels (29, 30, 31, 32) provide the second predetermined transmission ratio.

8. A manual drive arrangement for use in combination with and for manually driving a winch, said winch including an external drum and a rotational input shaft providing a drive for the winch and arranged to rotate said external drum at a first transmission ratio, the manual drive arrangement being separable from said winch and including a rotatable drive part with an axis of rotation, means including parts of said drive part and parts of said input shaft for non-rotatably coaxially coupling said drive part and said input shaft and enabling said manual drive arrangement to be coupled to and uncoupled from said drive part by relative axial shifting movement, of the drive arrangement and the drive part, so that the drive arrangement can be readily selectively removed from or placed on the winch, said manual drive arrangement further comprising a crank arm and drive transmission means enabling said crank arm to drivably co-act with said drive part to provide rotational movement to said drive part; wherein said separable manual drive arrangement constitutes a removable unit comprising said drive transmission means (12) connected between said crank arm and said drive part for transmitting rotational movement of the crank arm (5) to said drive part (4) at a second predetermined transmission ratio differing from said first transmission ratio of the winch, said manual drive arrangement further comprising a carrier unit (13) carrying said crank arm (5), said drive part (4) and said transmission means (12); torque reaction retaining means (14, 15) on said carrier unit, essentially non-rotationally mounted relative to the carrier unit; and abutment means at a fixed location relative to the winch enabling said torque reaction retaining means, and the carrier unit to which the retaining means is mounted, to be selectively rendered rotatably stationary by abutting said abutment means during the transmission of rotational movement to the drive part (4) by the crank arm; said torque reaction retaining means comprising an outwardly projecting carrier arm (14) on said carrier unit which extends substantially radially in relation to the rotational axis of said drive part (4) and said carrier arm carries a support member (15) which engages the abutment means (10); and wherein said support member is a bifurcated member (15) having two support legs (15'), said support member including an axial part (16) which extends substantially parallel with the rotational axis of said rotatable drive part (4), said axial part being arranged for limited axial movement relative to said carrier arm and being rotatable, said abutment means comprises a sheet (10) wound on and with a portion running off from said drum, and said bifurcated legs are adapted to straddle said sheet portion running off from said drum.

9. An arrangement according to claim 8, wherein at least one of said support legs is provided with a rotatable contact roller (17) having a concave outer profile for guiding the sheet.

* * * * *

UNITED STATES PATENT AND TRADEMARK OFFICE

CERTIFICATE OF CORRECTION

PATENT NO. : 5,048,799

DATED : September 17, 1991

INVENTOR(S) : MIKAEL E.G. ARONOWITSCH; STEFAN E.M. ARONOWITSCH; KARL LYTH; and TOR HARALD PEDERSEN It is certified that error appears in the above-identified patent and that said Letters Patent is hereby corrected as shown below:

ON THE COVER SHEET:

The street name in the address of the first named Inventor should be --Predikantvägen--.

The street name in the address of the third named Inventor should be --Polhemsgatan--.

The name, address and citizenship of the fourth Inventor has not been printed, and should be as follows:

--TOR HARALD PEDERSEN,
ROVEVEJEN 5,
N-3080 HOLMESTRAND, NORWAY

Signed and Sealed this

Ninth Day of March, 1993

*Attest:*

STEPHEN G. KUNIN

*Attesting Officer*

*Acting Commissioner of Patents and Trademarks*